United States Patent [19]

Motomura

[11] Patent Number: 4,804,036

[45] Date of Patent: Feb. 14, 1989

[54] ELECTROMAGNETIC EXHAUST VALVE FOR USE IN METAL CASTING

[75] Inventor: Noriyuki Motomura, Zama, Japan

[73] Assignee: Toshiba Kikai Kabushiki Kaisha, Tokyo, Japan

[21] Appl. No.: 188,454

[22] Filed: Apr. 29, 1988

[30] Foreign Application Priority Data

Apr. 30, 1987 [JP] Japan ..... 62-65809[U]

[51] Int. Cl.[4] ..... B22D 17/00; B22D 27/02

[52] U.S. Cl. ..... 164/147.1; 164/305

[58] Field of Search ..... 164/305, 146, 147.1, 164/498, 113, 119

[56] References Cited

FOREIGN PATENT DOCUMENTS 60-82262 5/1985 Japan ..... 164/305

*Primary Examiner*—Kuang Y. Lin

*Attorney, Agent, or Firm*—Cushman, Darby & Cushman

[57] ABSTRACT

In a casting apparatus, an electromagnetic pump is installed above a mold cavity. A molten metal contained in a crucible is forced into the mold cavity. The electromagnetic pump acts not only to exhaust gas or air in the mold cavity but also applies a downward force to the molten metal rising above the upper surface of the mold cavity.

4 Claims, 3 Drawing Sheets

ELECTROMAGNETIC EXHAUST VALVE FOR USE IN METAL CASTING

BACKGROUND OF THE INVENTION

This invention relates to an electromagnetic exhaust valve for use in metal casting and, more particularly, to an electromagnetic exhaust valve adapted to exhaust gas and air in the mold cavity in a metal mold used in metal casting and to press down molten metal rising above the mold cavity.

One example of a prior art metal casting apparatus will firstly be described with reference to FIG. 2 of the accompanying drawings.

As shown, a stationary metal mold 12 is secured to the upper surface of a stationary die plate 11, while a movable metal mold 13 opposing the stationary metal mold 12 is secured to the lower surface of a movable die plate 14. When mated together, the stationary and movable metal molds 12 and 13 define therebetween a mold cavity 15. A crucible 17 containing molten metal 16 is secured to the lower surface of the stationary die plate 11. The molten metal 16 is filled into the cavity 15 through a stalk 18 secured to the stationary die plate 11 by applying compressed air on the upper surface of the molten metal from a source of pressurized gas 50 as shown by arrows.

For the purpose of exhausting to the outside gas and air existing in the cavity 15 at the time of filling the molten metal into the cavity, exhaust plugs 20 are provided between a cavity 15 and a chamber 19 communicated with the atmosphere. An ejector 21 is provided in the chamber 19 for ejecting a casting out of the cavity 15. More particularly, after casting a product, as the movable die plate 14 is retracted upwardly, the casting too is moved upwardly together with the movable metal mold 13. At this time, the ejector 21 is moved downwardly by a push rod, not shown, to cause the casting to drop.

As diagrammatically shown in FIGS. 3 and 4, each exhaust plug 20 has a tubular configuration 26 provided with a plurality of axial grooves 27 on the peripheral surface or a plurality of axial openings 28. Alternatively, a body 26 of sintered metal powder, shown in FIG. 5, is used. For the purpose of permitting the plugs 20 to discharge gas or air but preventing the plugs from passing the molten metal, the sizes of grooves 27 and openings 28 are made small, for example about 0.2 mm. Accordingly, not only the exhausting efficiency is small but also a long time is necessary for effecting sufficient exhaustion, thus decreasing the productivity. Sometimes, the quantity of the filled molten metal becomes deficient, resulting in rejects. If the cross-sectional areas of the grooves 27 and openings 28 were too large, the molten metal would enter into these grooves or openings and solidify therein. Such clogged plugs cannot be used again.

SUMMARY OF THE INVENTION

Accordingly, it is an object of this invention to provide a novel eletromagnetic exhaust valve for use in metal casting capable of eliminating various defects described above and increasing the efficiency of exhuasting gas or air existing in a mold cavity.

According to this invention, there is provided an electromagnetic exhaust valve for use in metal casting comprising a stationary metal mold, a movable metal mold, the stationary and movable metal molds defining a mold cavity therebetween when they are mated together, an exhaust opening extending from one side of the mold cavity through the movable metal mold, an electromagnetic pump surrounding said exhaust opening, a molten metal sensor provided in the exhaust opening for energizing the electromagnetic pump when the molten metal comes into contact with the molten metal sensor, and means for supplying the molten metal into the mold cavity from the other side thereof.

DESCRIPTION OF THE PREFERRED EMBODIMENT

Figure 1:
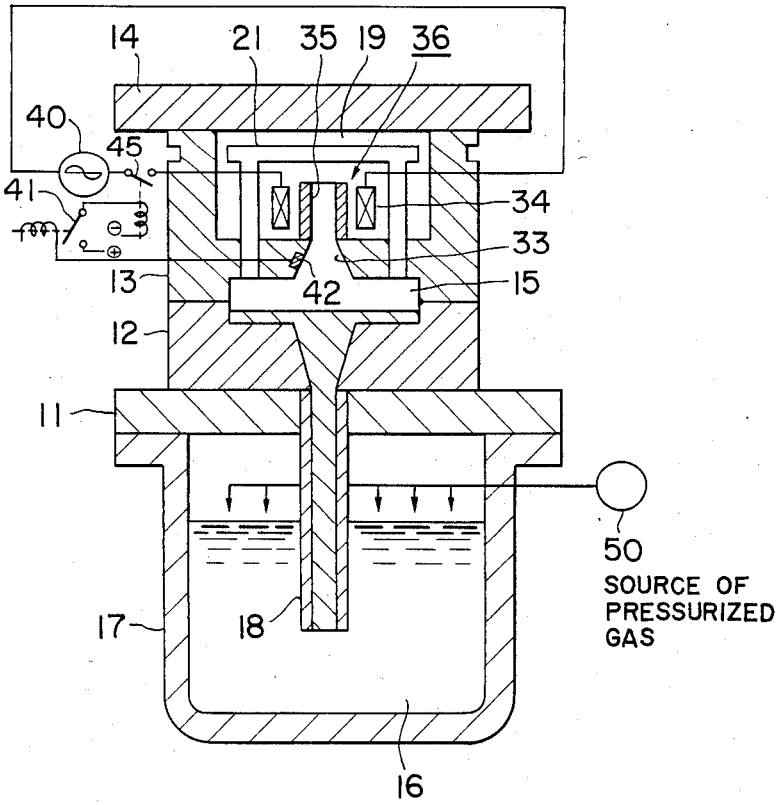
FIG. 1 is a vertical sectional view showing an electromagnetic exhaust valve constructed in accordance with the teaching of this invention and utilized for casting molten metal into a mold cavity.
Figure 2:
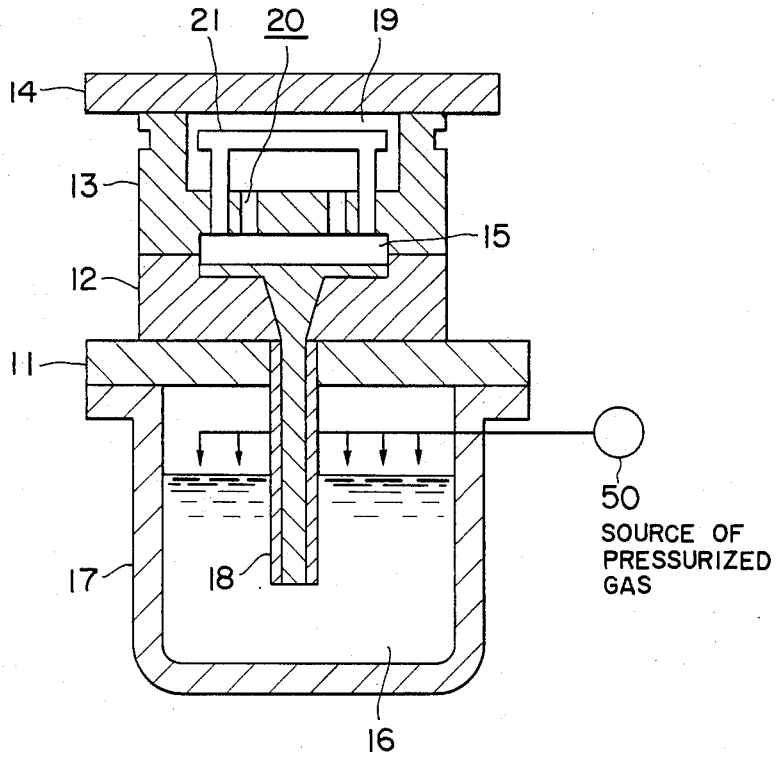
FIG. 2 PRIOR ART
FIG. 2 is a vertical sectional view showing a prior art molten metal casting apparatus.
Figure 3:
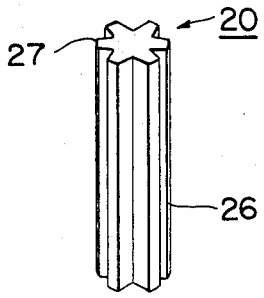
FIG. 3 PRIOR ART
FIGS. 3, 4 and 5 are perspective views showing various plugs utilized in the prior art casting apparatus shown in FIG. 2.
Figure 4:
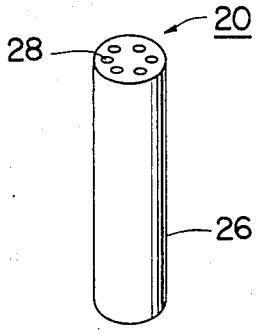
FIG. 4 PRIOR ART
Figure 5:
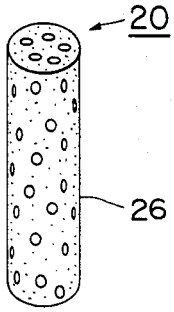
FIG. 5 PRIOR ART

In FIG. 1, elements corresponding to those shown in FIG. 2 are designated by the same reference numerals so that only the elements added to FIG. 2 will be described. At the center of the lower wall of the movable metal mold 13 is formed an inverted funnel shaped exhaust channel or opening 33 between the mold cavity 15 and the chamber 19 communicated with the atmosphere so as to exhaust gas or air in the cavity 15. An electromagnetic pump 36 including a coil 34 and a duct 35 is disposed to surround the upper portion of the exhaust channel 33. The coil 34 is connected to an AC source 40 through an electromagnetic switch 41 which is actuated by a molten metal sensor 42 provided for the inclined surface of the inverted funnel shaped exhaust channel 33 at a position near the upper surface of the cavity.

In operation, when compressed air is applied to the upper surface of the molten metal 16 from the source 50, the molten metal is raised to fill the cavity 15 through stalk 18. As the molten metal comes into contact with the molten metal sensor 42 to close electromagnetic switch 41, the coil 34 of the electromagnetic pump is energized by the AC source 40 through switch 45 energized as a result of closure of switch 41. The electromagnetic exhaust valve 36 is designed such that it will apply a downward force to the molten metal rising upwardly through channel 33 and that when the upper surface of the molten metal comes to be flush with the upper surface of the cavity the pump is stopped, thereby forming a casting having a flat surface. This object can be attained by providing a timer which deenergizes the coil 34 a predetermined tie after closure of the switch 41. After solidification of the cast metal, ejector 21 is actuated to eject the casting in a manner as above described. As above described, the electromagnetic pump not only operates as an exhaust valve but also operates to press down the molten metal entered into the channel 33 to a level flush with the upper surface of the cavity 15. The electromagnetic pump not only widens the cross-sectional area of the exhaust opening for exhausting the gas or air in the mold cavity but also decreases the number of defective products caused by deficient or excessive quantity of the poured molten metal.

What is claimed is:

1. An electromagnetic exhaust valve incorporated with a casting mold for use in metal casting comprising:

a stationary metal mold;

a movable metal mold;

said stationary and movable metal molds defining a mold cavity therebetween when they are mated together;

an exhaust opening extending from one side of said mold cavity through said movable metal mold;

an electromagnetic pump surrounding said exhaust opening;

a molten metal sensor provided in said exhaust opening for energizing said electromagnetic pump when said molten metal comes into contact with said molten metal sensor; and means for supplying said molten metal into said mold cavity from the other side thereof.

2. The electromagnetic valve according to claim 1 wherein said casting apparatus comprises a crucible located beneath said stationary metal mold and containing said molten metal, a stalk with one end immersed in said molten metal contained in said crucible, and the other end communicated with said mold cavity, and a source of compressed gas for applying pressurized gas to said molten metal in said crucible.

3. The electromagnetic valve according to claim 1 wherein said electromagnetic pump applies a downward force to the molten metal rising through said exhaust opening.

4. The electromagnetic valve according to claim 1 wherein said exhaust opening takes the form of an inverted funnel and said molten metal sensor is embedded in an inclined surface of said funnel.

* * * * *